United States Patent [19]

Iwahara et al.

[11] 4,159,397

[45] Jun. 26, 1979

[54] ACOUSTIC TRANSLATION OF QUADRAPHONIC SIGNALS FOR TWO- AND FOUR-SPEAKER SOUND REPRODUCTION

[75] Inventors: Makoto Iwahara; Toshinori Mori, both of Yokohama, Japan

[73] Assignee: Victor Company of Japan, Limited, Japan

[21] Appl. No.: 903,774

[22] Filed: May 5, 1978

[30] Foreign Application Priority Data

May 8, 1977 [JP] Japan ..... 52/52402
May 8, 1977 [JP] Japan ..... 52/52403

[51] Int. Cl.[2] ..... H04R 5/00

[52] U.S. Cl. ..... 179/1 GQ; 179/1 GP; 179/1 G

[58] Field of Search ..... 179/1 GQ, 1 GP, 1 G, 179/100.1 TD, 100.4 ST

[56] References Cited

U.S. PATENT DOCUMENTS

| | | | |
|---|---|---|---|
| 3,088,997 | 5/1963 | Bauer | 179/1 G |
| 3,236,949 | 2/1966 | Atal et al. | 179/1 G |
| 3,238,304 | 3/1966 | Yaita et al. | 179/1 G |
| 3,710,023 | 1/1973 | Greuzard et al. | 179/1 G |
| 3,892,624 | 7/1975 | Shimada | 179/1 G |
| 3,925,615 | 12/1975 | Nakano | 179/1 GQ |
| 4,118,599 | 10/1978 | Iwahara et al. | 179/1 GP |

*Primary Examiner*—Douglas W. Olms
*Attorney, Agent, or Firm*—Lowe, King, Price & Becker

[57] ABSTRACT

Each of quadraphonic signals is applied to a respective one of a plurality of binaural localization networks to deliver a pair of binaurally correlated output signals to a respective one of a plurality of crosstalk cancellation networks where the input signals are modified so as to eliminate acoustic crosstalk which might be perceived by a listener if the non-modified signals were directly used to produce sound waves. The output signals from each crosstalk cancellation network are a pair of crosstalk-free signals which are combined in adders with signals from the other crosstalk cancellation networks to deliver a plurality of localized output signals to loudspeakers. The localization networks are so adjusted to make the localized output signals to appear to originate from anywhere in front of a listener.

17 Claims, 19 Drawing Figures

TO SPEAKER R
TO SPEAKER L
UNCONNECTED
40
Ra
La
Rd
Ld
41
42
43
44
RFa
LFa
RBa
LBa
FROM ADDER 31
FROM ADDER 32
FROM ADDER 33
FROM ADDER 34

53
R
L
51
52
Ra
La
40
41
42
RFa
LFa
RBa
LBa
31
32
33
34
RFr
RFl
LFr
LFl
RBr
RBl
LBr
LBl
14-1
14-2
14-3
14-4
C.C.N.
12-1
12-2
12-3
12-4
B.L.N.
RF
LF
RB
LB

ACOUSTIC TRANSLATION OF QUADRAPHONIC SIGNALS FOR TWO- AND FOUR-SPEAKER SOUND REPRODUCTION

BACKGROUND OF THE INVENTION

The present invention relates generally to stereophonic sound recording and reproduction systems, and more particularly to acoustic translators which permit localization of sonic images so as to provide a set of four-channel signals which is compatible to both two-channel and four-channel reproduction systems.

In conventional quadraphonic sound recording, the microphones are so arranged with respect to each other and the recorded signals are so synthesized as to create a desired acousto-psychological effect in a specific arrangement of four speakers. It is often desired to reproduce the quadraphonic recorded material on two-speaker systems, which is usually effected by combining the components of the quadraphonic signals to produce a pair of output signals to be delivered to the speakers. However, the two-speaker reproduction of the quadraphonic signals results in localization of sonic images at different positions from those as originally intended in the four-speaker reproduction.

SUMMARY OF THE INVENTION

An object of the present invention is to provide an acoustic translator which permits quadraphonic signals to be made to appear to originate from desired positions so as to simulate a pseudo-quadraphonic effect in two-speaker arrangements.

The present invention is characterized by the use of a plurality of cascaded or tandem connections of a binaural localization network and a crosstalk cancellation network and a plurality of additive networks which are associated with the crosstalk cancellation networks. Each of the binaural localization networks is in receipt of a respective one of the original quadraphonic signals to generate a set of first and second binaurally correlated signals which are coupled to the associated crosstalk cancellation network to produce a set of third and fourth signals. The localization network is so basically designated that the first and second signals may create the impression of sound coming from a desired angle to the center line of a listener's position, on the assumption that these signals were directly sensed by the listener's respectively ears. The crosstalk cancellation network modifies the first and second signals so as to eliminate crosstalk which might be perceived by the listener when seated at distances from the speakers if the first and second signals were used to directly energize the speakers. The binaurally correlated, crosstalk-free signals are then combined in adders to give a pair of output signals to be delivered to the two speakers in front of the listener. By suitably selecting the frequency and delay parameters of the localization networks, the output signals from the adders, which would normally be made to appear to originate from the two loudspeaker positions or from positions between them, may be made to appear to originate from anywhere in a half plane.

BRIEF DESCRIPTION OF THE DRAWINGS

The invention will be further described with reference to the accompanying drawings, in which.

DETAILED DESCRIPTION

Figure 1:
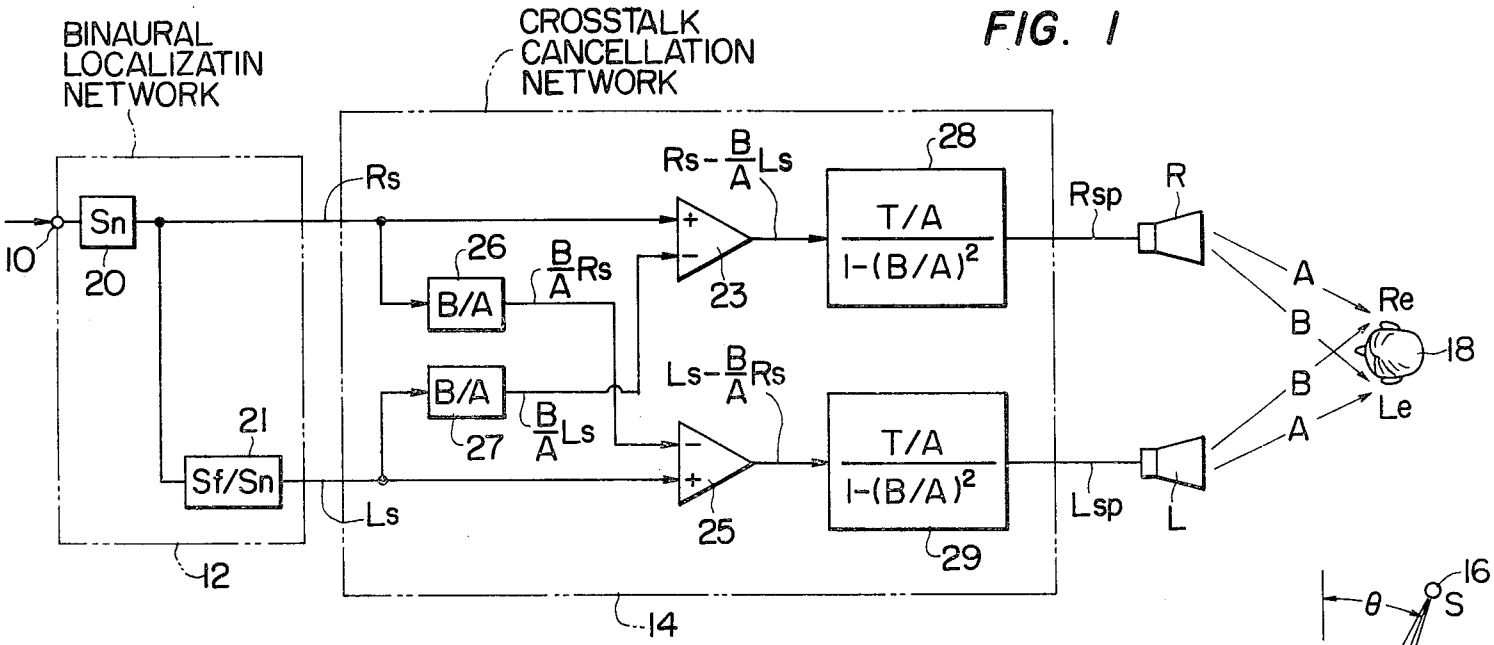
FIG. 1 is an illustration of the basic functional blocks of the invention including a cascaded connection of a binaural localization network and a crosstalk cancellation network shown connected to a pair of loudspeakers.
Figure 2:
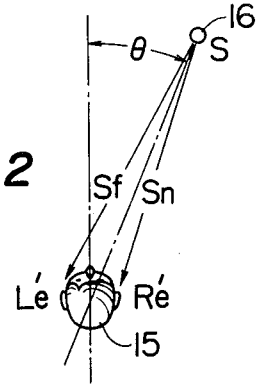
FIG. 2 is a pictorial diagram illustrating the relation to one another of sound pressure waves radiated from two loudspeakers in producing an arbitraily located sonic image in accordance with the localization network of FIG. 1.

FIG. 1 illustrates the basic functional blocks of the invention. An input audio signal, which carries no information as to the localization of the source of the audio signal, such as monaural signal or a respective channel signal of stereophony, is applied to an input terminal 10 of a binaural localization network 12. The localization network 12 is to localize the origin of acoustic energy at any desired location with respect to a listener as depicted in FIG. 2. Assume that in FIG. 2 the listener 15 has an impression that he hears sound coming from a virtual sound source 16 which is located at a position at an angle $\theta$ from the center line of his position. If a signal with an intensity level S is radiated from the sound source 16, the signal will be transmitted over acoustic paths having transfer function represented by Sn and Sf to the listener 15 to produce sound pressures Le' and Re' at the respective ears of the listener. The sound wave pressures are expressed by the following matrix representation:

$$\begin{bmatrix} Re' \\ Le' \end{bmatrix} = S \begin{bmatrix} Sn \\ Sf \end{bmatrix} \tag{1}$$

Equation 1 can be rewritten as follows:

$$\begin{bmatrix} Re' \\ Le' \end{bmatrix} = S \cdot Sn \begin{bmatrix} 1 \\ Sf/Sn \end{bmatrix} \quad (2)$$

Figure 3:
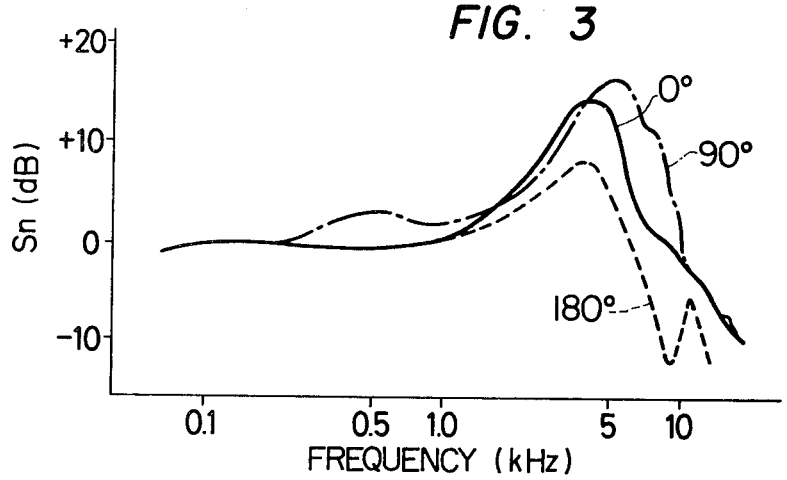
FIGS. 3–5 are suitable frequency characteristics of the binaural localization network.
Figure 4:
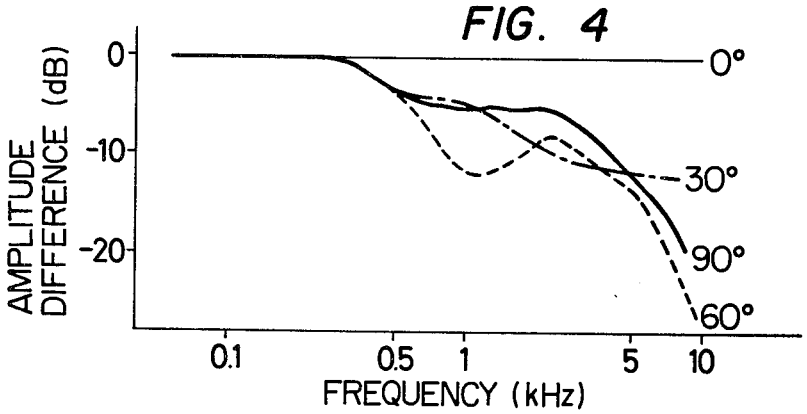
Figure 5:
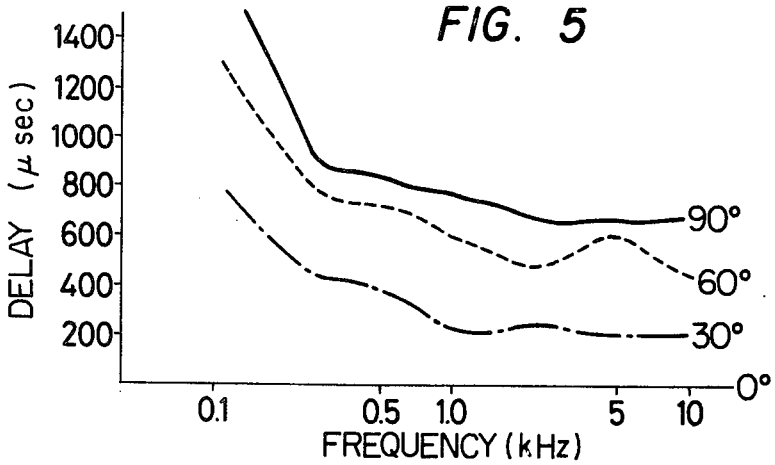

The binuaral localization network 12 includes a filter circuit 20 having a particular frequency response characteristic as illustrated in FIG. 3 to simulate the transfer function Sn, and a filter-and-delay circuit 21 having amplitude-difference and delay characteristics as a function of frequency as illustrated in FIGS. 4 and 5 to simulate the transfer function Sf/Sn. As shown in FIG. 3, the network 20 has resonant peaks at frequencies in the audible frequency spectrum. The resonant peaks occur at particular frequencies associated with the displacement angle $\theta$ from the center line of the listener 15. For example, a resonant peak occurs at approximately 4 kHz for a displacement angle of zero degree while it occurs at approximately 5 kHz for a 90-degree displacement with an attendant small resonant peak or hump at 0.5 kHz. For a 180-degree displacement, a primary resonant peak occurs at approximately 4 kHz and a small resonant peak at approximately 10 kHz with an anti-resonant peak at approximately 9 kHz. The frequency response characteristic Sn with a displacement angle $\theta$ as a parameter is determined by plotting as a function of frequency the output from a microphone mounted in the position of the right ear of an artificial or dummy head oriented with respect to a sound source at a desired angle of displacement.

FIG. 4 depicts the amplitude-differential component of the transfer function Sf/Sn which is determined by a measurement of the difference between sound pressures Re' and Le' and plotting it as a function of frequency for a given displacement angle $\theta$. The sound pressure Re' is available from the output of the microphone mounted in the right ear of the dummy head referred to above, while the sound pressure Le' is obtained from the output of another microphone mounted in the corresponding position of the left ear of the dummy head. As illustrated in FIG. 4, the amplitude difference increases with frequency in a range from approximately 0.2 kHz to 10 kHz and varies appreciably between different displacement angles. FIG. 5 shows the delay component of the transfer function Sf/Sn which is obtained from a plot of the difference in transmission time between signals corresponding to sound pressures Re' and Le' as a function of frequency for a given displacement angle $\theta$. As illustrated, the delay component decreases with frequency with different tendencies between displacement angles.

It is to be understood from the above discussion that the binaural localization network 12 develops a binaural or head-referenced representation of an input monaural signal so that its output is binaurally correlated signals which localize a binaural or head-referenced sonic image at a desired location with respect to a listener.

Referring again to FIG. 1, the filter-and-delay circuit 21 is connected to receive the output from the filter circuit 20 to deliver an output signal Ls. The output signal from the filter circuit 20 is a signal Rs which together with the signal Ls would produce the same sound pressures Re' and Le' if the loudspeakers that are fed with these signals individually are located very close to the respective ears of a listener. However, under normal sound reproduction, the listener is seated at distances from the speakers so that he would hear unwanted sound in addition to wanted sound, a phenomenon known as acoustical crosstalk, if the signals Ls and Rs are directly fed to the speakers.

The crosstalk cancellation circuit 14 is to eliminate such crosstalk phenomenon by modifying the input signals Ls and Rs into crosstalk-free signals Lsp and Rsp which, when fed to left and right speakers L and R, respectively, would produce a cancellating effect on the crosstalk components of the sound waves arriving at the listener's ears. This is done by equating the resultant sound pressures Le and Re at the left and right ears of a listener 18 seated at equal distances from the speakers L and R to the sound pressures Le' and Re' described in connection with FIG. 2. Therefore, the following relation should hold:

$$\begin{bmatrix} Le \\ Re \end{bmatrix} = K \begin{bmatrix} Lsp \\ Rsp \end{bmatrix} \quad (3)$$

where $$K = \begin{bmatrix} A & B \\ B & A \end{bmatrix},$$

where A is the transfer characteristic of the paths between speakers L and R and the listener's left and right ears, respectively, and B is the transfer characteristics of the crossover paths between the speakers L and R and the listener's right and left ears, respectively.

The signals Lsp and Rsp are thus given as follows:

$$\begin{bmatrix} Lsp \\ Rsp \end{bmatrix} = T \cdot K^{-1} \cdot \begin{bmatrix} Ls \\ Rs \end{bmatrix}$$

where, T is a delay time which must be included for practical purposes and $K^{-1}$ is an inverse matrix of K. By rearranging Equation 4 the following relations are obtained:

$$Lsp = \frac{1/A}{1-(B/A)^2}\left(Ls - \frac{B}{A}Rs\right)T \quad (4a)$$

$$Rsp = \frac{1/A}{1-(B/A)^2}\left(Rs - \frac{B}{A}Ls\right)T \quad (4b)$$

To implement Equations 4*a* and 4*b*, the crosstalk cancellation network 14 is comprised by a subtractor 23 connected to receive the signal Rs and a substractive signal (B/L)Ls through a filter-and-delay network 27 having a transfer function represented by B/A. The algebraically combined output signal from the subtractor 23 is fed to a filter-and-dely network 28 having a transfer function represented by $T/A/1-(B/A)^2$. Since the output signal from the subtractor 23 is Rs−(B/A)Ls, the resultant signal Rsp at the output of the network 28 is identical to that obtained by Equation 4*b*. In a similar manner, a subtractor 25 is provided to receive the signal Ls and a subtractive signal (B/A)Rs through a filter-and-delay network 26 having a transfer function represented by B/A to deliver an algebraically combined output signal Ls−(B/A)Rs to a filter-and-delay network 29 having an identical transfer function to that of network 28, all of which networks are arranged symmetrically with respect to the networks which produce signal Rsp so as to derive signal Lsp.

Figure 6:
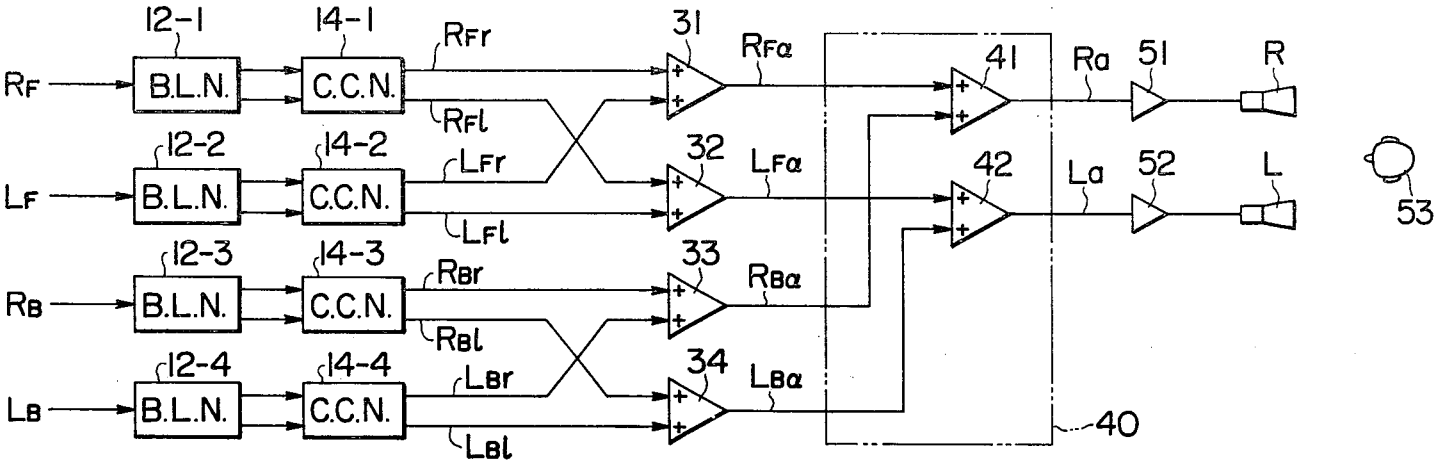
FIG. 6 is a schematic block diagram of a first embodiment of the invention which permits reproduction of a pseudo-quadraphonic effect in a two-speaker arrangement.

Referring to FIG. 6 a first embodiment of the invention is illustrated incorporating the basic functional blocks as described previously. A set of right-forward ($R_F$), left-forward ($L_F$), right-backward ($R_B$) and left-backward ($L_B$) signals are applied respectively to the inputs to binaural localization networks 12-1, 12-2, 12-3 and 12-4 and thence to crosstalk cancellation networks 14-1, 14-2, 14-3 and 14-4, respectively. The right and left signals of each forward and backward pair are stereophonic correlated signals which may be derived from respective microphones or a program source such as a four-channel sound tape, and each of these signals is itself a monaural signal. After processing through each cascaded connection of the localization and crosstalk cancellation networks, each monaural signal is converted into a pair of binaurally correlated right and left signals. A set of adders 31, 32, 33 and 34 is provided: the adder 31 providing summation of the right components $R_{Fr}$ and $L_{Fr}$ of the outputs of the cancellation networks 14-1 and 14-2 to deliver a summation output signal $R_{Fa}$ and the adder 32 providing summation of the left components $R_{Fl}$ and $L_{Fl}$ of the outputs of the cancellation networks 14-1 and 14-2 to deliver a summation output signal $L_{Fa}$. Similarly, adders 33 and 34 deliver summation output signals $R_{Ba}$ and $L_{Ba}$ which are respectively the summation of $R_{Br}$ and $L_{Br}$ and the summation of $R_{Bl}$ and $L_{Bl}$, respectively. The summation outputs $R_{Fa}$ and $R_{Ba}$ are algebraically combined in an adder 41, which results in a right-channel output signal Ra for delivery through amplifier 51 to the right speaker R, while the summation outputs $L_{Fa}$ and $L_{Ba}$ are algebraically combined in an adder 42 to generate a left-channel output signal La for delivery through amplifier 52 to the left speaker L.

It will be understood that since each of the localization networks is designed to provide localization of a sonic image at any desired location upon reproduction, it is possible to localize virtual or phantom sources anywhere within a range of 180-degree plane in front of a listener 53.

Figure 7:
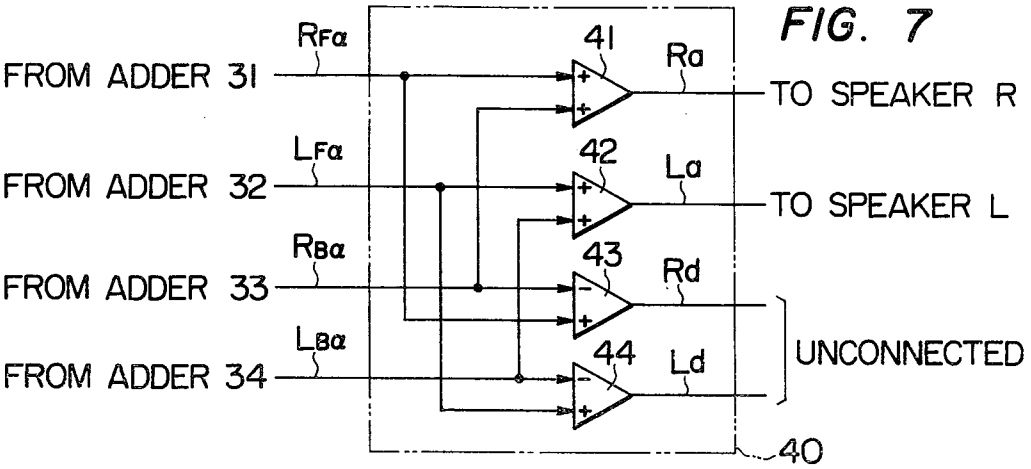
FIG. 7 is a schematic diagram of a preferred modification of the embodiment of FIG. 6.

Since it is desirable to permit a four-channel record to be reproduced on four-speaker systems as well as on two-speaker systems, the use of a matrix circuit 40 shown in FIG. 7 is preferred, which circuit provide summation outputs Ra and La and difference signals Rd and Ld for rear speakers (not shown) in the case of four-channel reproduction. The matrix 40 includes, in addition to adders 41 and 42, subtractors 43 and 44, the subtractor 43 providing subtraction of output signal $R_{Ba}$ from output signal $R_{Fa}$ to provide difference signal Rd and the subtractor 44 providing subtraction of output signal $L_{Ba}$ from output signal $L_{Fa}$ to provide difference signal Ld.

All of the summation and difference signals may be recorded on two physically separated tracks of a record disk using the conventional four-channel recording technique such as CD-4. It is also possible to provide broadcasting of the four-channel signals by feeding the summation and difference signals Ra, La, Rd and Ld to a four-channel broadcasting system known as Dorren system.

Figure 8:
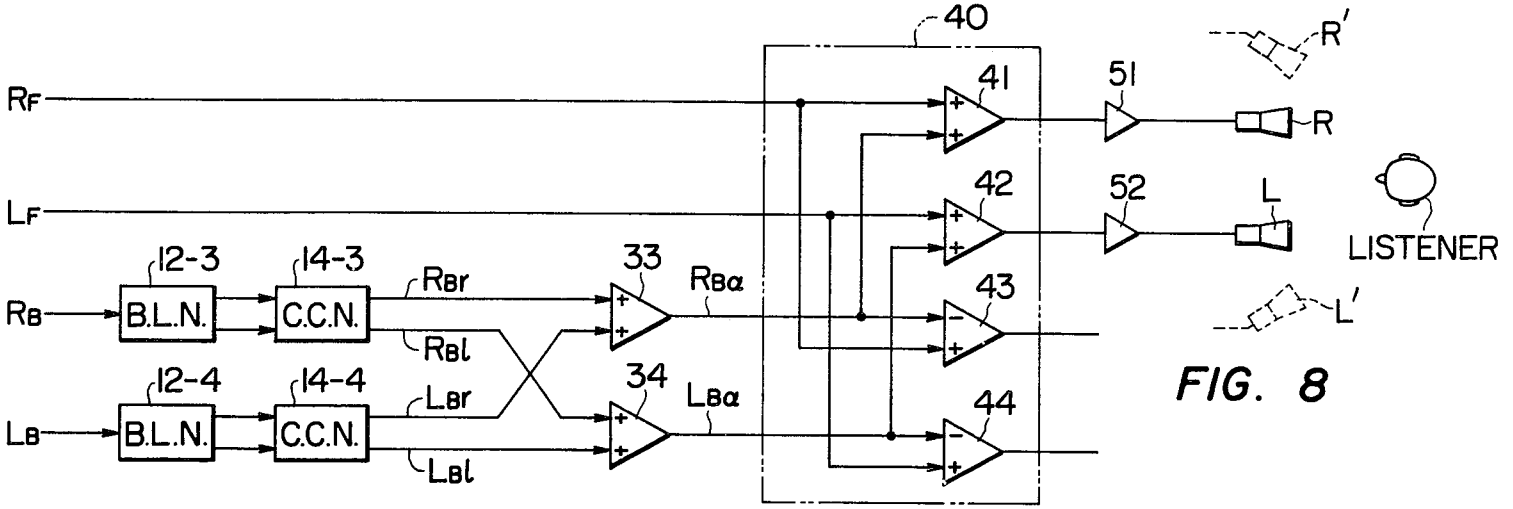
FIGS. 8–9 are schematic diagrams of modifications of the embodiment of FIG. 6.
Figure 9:
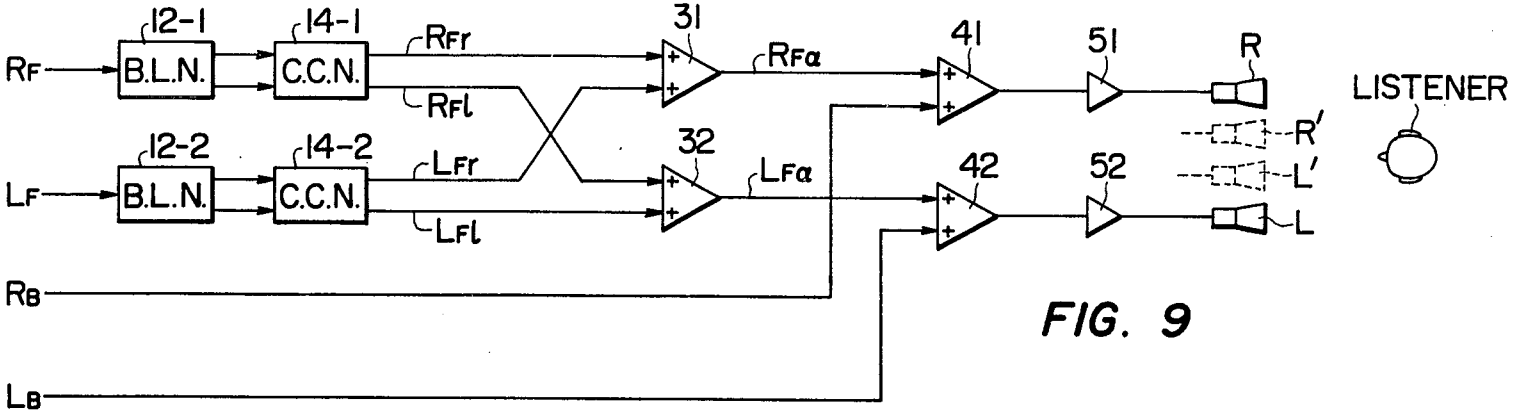

Modifications of the embodiment of FIG. 6 are illustrated in FIGS. 8 and 9. The modification shown in FIG. 8 is generally similar to the FIG. 6 embodiment except that the right- and left-forward signals $R_F$ and $L_F$ are directly applied to the adders 41 and 42, respectively, so that signal $R_F$ is algebraically combined with the signal $R_{Ba}$ from adder 33 to drive the right speaker R with the combined output. Likewise, the signal $L_F$ is algebraically combined with the signal $L_{Ba}$ from adder 34 to drive the left speaker L with the combined output. The non-processed, direct signal components $R_F$ and $L_F$, when applied to the respective speakers, contribute to the creation of sonic images at the location of the respective speakers. The localization networks 12-3 and 12-4 are so adjusted that the original rear sound signals $R_B$ *and* $L_B$ are made to appear to originate from anywhere rightwardly of the right speaker R as at R′ and from anywhere leftwardly of the left speaker L as at L′, respectively.

The modification shown in FIG. 9 is also generally similar to the FIG. 6 embodiment except that the right- and left-backward signals $R_B$ and $L_B$ are directly applied to the adders 41 and 42, respectively, so that signal $R_B$ is algebraically combined with the signal $R_{Fa}$ from adder 31 to drive the right speaker R with the combined output. Likewise, the signal $L_B$ is algebraically combined with the signal $L_{Fa}$ to drive the left speaker L. In contrast with the embodiment of FIG. 8, the directly applied rearward signals $R_B$ and $L_B$ are used to localize their sonic images at the position of the respective speakers. The localization networks 12-1 and 12-2 are so adjusted that the forward signals $R_F$ and $L_F$ are made to appear to originate from anywhere between the speakers R and L as at R′ and L′.

In the previous embodiments, two speakers are used for reproduction of a set of the processed or modified signals. In cases where it is desired to use four speakers for reproduction of the modified signals as processed in accordance with the previous embodiments, the listener would have an acousto-psychological impression different from what is originally intended to create using the non-modified stereophonic signals. Therefore, it is desirable to provide compatibility between two-speaker and four-speaker reproduction so that the modified stereophonic signals may also be reproduced through four speakers without creating the impression of a difference from what is originally intended by designers or program producers.

Figure 10:
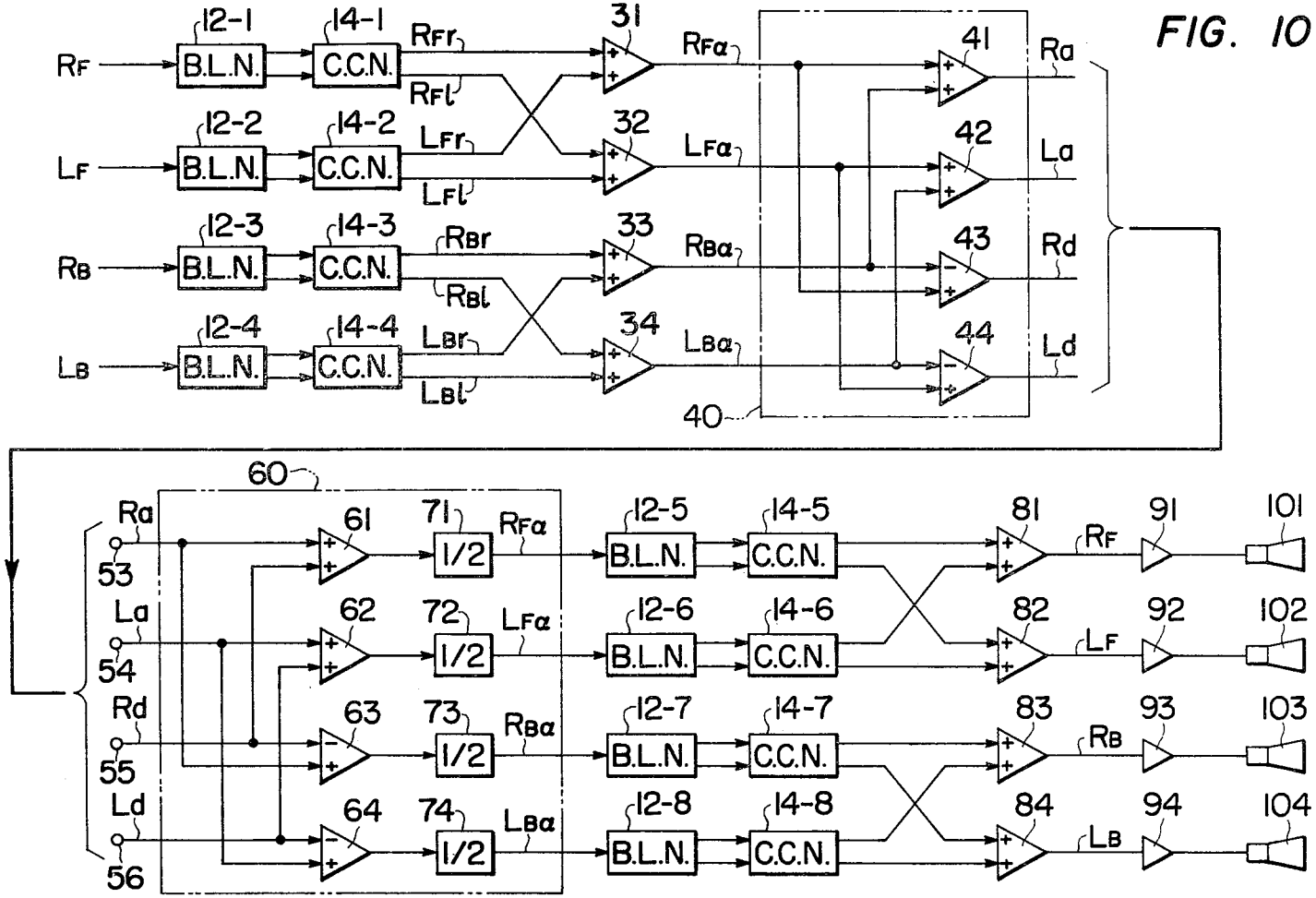
FIG. 10 is a schematic diagram of a second embodiment of the present invention which permits reproduction of a quadraphonic effect in a four-speaker arrangement based upon the localized output signals of the embodiment of FIG. 6.
Figure 11:
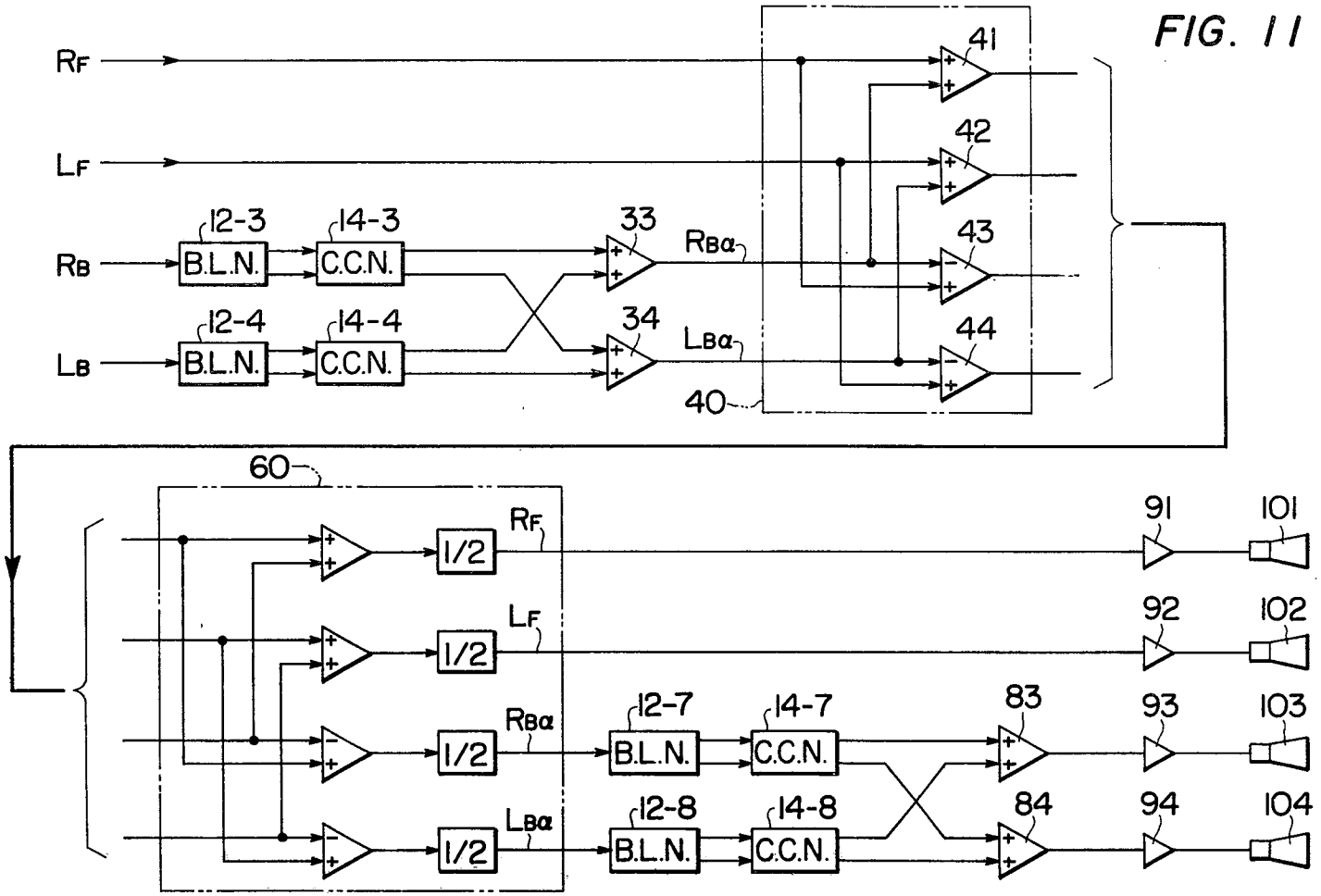
FIGS. 11–12 are schematic diagrams of modifications of the embodiment of FIG. 10.
Figure 12:
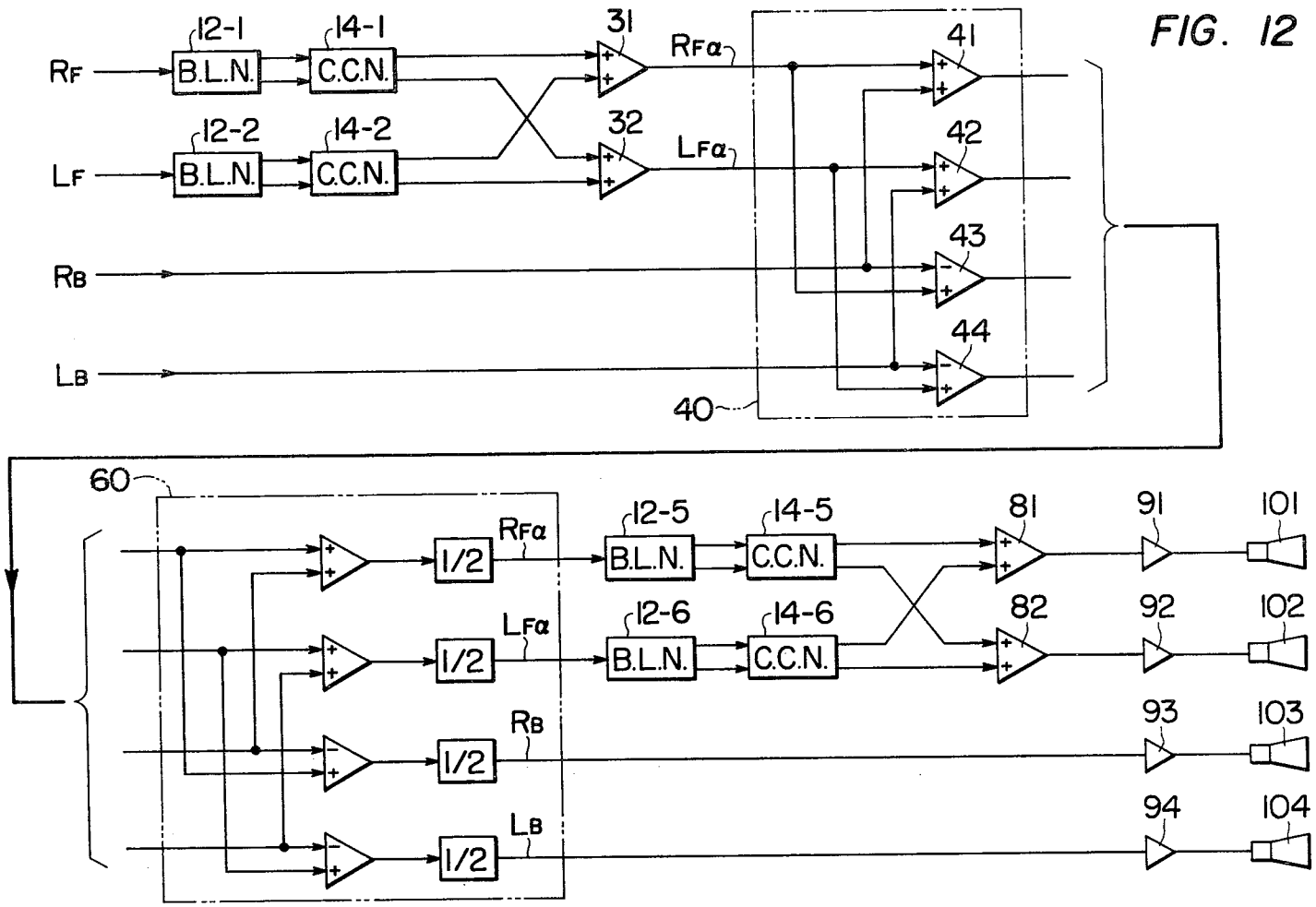

FIGS. 10, 11 and 12 are illustrations of second embodiments of the invention which are intended for use in four-speaker reproduction of the stereophonic signals modified in accordance with the embodiments of FIGS. 6, 8 and 9, respectively, and in which like parts are identified with like numerals throughout.

In FIG. 10, the system is divided into a recording section which is identical with the embodiment of FIG. 6 with the exception that matrix circuit 40 of FIG. 7 is employed, and a reproducing section which includes a matrix circuit 60 to convert the output signals from the recording section into the original $R_{Fa}$, $L_{Fa}$, $R_{Ba}$ and $L_{Ba}$. As illustrated, the matrix circuit 60 includes an adder 61 to provide summation of the additive signal Ra ($=R_{Fa}+R_{Ba}$) and the difference signal Rd ($=R_{Fa}-R_{Ba}$) to deliver a signal $2R_{Fa}$ which is attenuated by attenuator 71 to one half of its input level so that signal $R_{Fa}$ is derived. In the same fashion, a series circuit including adder 62 and attenuator 72 delivers a signal $L_{Fa}$. The signals $R_{Fa}$ and $L_{Fa}$ are applied to binaural localization networks 12-5 and 12-6, respectively, where the input signals are individually processed and then applied to crosstalk cancellation circuits 14-5 and 14-6, respectively. The output circuits of the cancellation networks 14-5 and 14-6 are connected to adders 81 and 82 in the same configuration as the output circuits of the cancellation networks 14-1 and 14-2 are connected to the adders 31 and 32. The binaural localization networks 12-5 and 12-6 are so designed that the output signals from the adders 81 and 82 respectively correspond to the original forward stereophonic signals $R_F$ and $L_F$. The outputs from the adders 81 and 82 are amplified at 91 and 92, respectively, and fed to a right-forward speaker 101 and a left-forward speaker 102, respectively. The matrix circuit 60 further includes a pair of subtractors 63 and 64, the subtractor 63 providing subtraction of the difference signal Rd from the summation signal Ra to derive a signal $2R_{B\alpha}$ which is attenuated to one half of its magnitude by attenuator 73. Likewise, the subtractor 64 provides subtraction of the difference signal Ld from the summation signal La to derive $2L_{B\alpha}$ which is attenuated to one half of its magnitude by attenuator 74. The signals $R_{B\alpha}$ and $L_{B\alpha}$ are applied to binaural localization networks 12-7 and 12-8 and thence to crosstalk cancellation networks 14-7 and 14-8, respectively. The output signals from the cancellation networks 14-7 and 14-8 are connected to adders 83 and 84 in the same manner as described above. The binaural localization networks 12-7 and 12-8 are so designed that the output signals of adders 83 and 84 correspond to original backward stereophonic signals $R_B$ and $L_B$, respectively. The outputs from the adders 83 and 84 are applied through amplifiers 93 and 94 to a right-backward speaker 103 and a left-backward speaker 104, respectively. It is thus appreciated that the speakers 101 through 104 are fed with individual signals which correspond to the original signals so that sonic images are created in the same locations as would be created if the original signals are directly applied to the speakers.

Consider now a situation in which two-channeled stereophonic signals are reproduced using the reproduction section of the embodiment of FIG. 10. In this case, a right signal R is applied to input terminals 53 and 55 instead of signals Ra and Rd and a left signal L is applied to input terminals 54 and 56 instead of signals La and Ld. It will be appreciated that the output signals from the attenuators 71, 72, 73 and 74 correspond respectively to signals R, L, R, L. Therefore, the sterophonic signals R and L from attenuators 71 and 72 are modified by the later stages in the same manner as described above to energize the front speakers 101 and 102, respectively. Likewise, the other set of stereophonic signals from attenuators 73 and 74 are modified by the netwworks 12-7, 12-8 and 14-7, 14-8 to energize the backward speakers 103 and 104. The loudspeakers 101 through 104 are so located that the sonic images created by the sound radiated from the rear speakers 103 and 104 are localized at the same locations as those created by the front speakers 101 and 102. With the speakers 101 through 104 so arranged, it is possible to create the same realism as that created by two-speaker systems, which was impossible with the conventional four-speaker reproduction systems.

In the embodiment of FIG. 11, forward-right and left signals $R_F$ and $L_F$ are directly applied to the matrix circuit 40, while the backward-right and left signals $R_B$ and $L_B$ are modified by the binaural localization networks 12-3 and 12-4 and the crosstalk cancellation networks 14-3 and 14-4, respectively, to derive outputs which are combined in adders 33 and 34 to derive signals $R_{B\alpha}$ and $L_{B\alpha}$ in the same manner as previously described with reference to the embodiment of FIG. 8. It is seen that the output signals from adders 41 and 42 of the matrix 40 are a summation of $R_F$ and $R_{B\alpha}$ and a summation of $L_F$ and $L_{B\alpha}$, respectively, and that the output signals from subtractors 43 and 44 are a difference between $R_F$ and $R_{B\alpha}$ and a difference between $L_F$ and $L_{B\alpha}$, respectively.

In the reproducing section of the system, the matrix 60 performs the conversion of the input signals applied from the matrix 40 of the recording section into a set of signals corresponding to the input signals of the matrix 40, so that right- and left-forward speakers 101 and 102 are fed with signals $R_F$ and $L_F$ respectively. On the other hand, the signals $R_{B\alpha}$ and $L_{B\alpha}$ from the matrix 60 are processed by binaural localization networks 12-7, 12-8 and crosstalk cancellation networks 14-7, 14-8 and through adders 83, 84 to derive signal $R_B$ and $L_B$, respectively, for energization of right- and left-backward speakers 103 and 104.

FIG. 12 is an alternative embodiment of the invention in which the right- and left-backward signals $R_B$ and $L_B$ are directly applied to the matrix 40, while the right- and left-backward signals $R_F$ and $L_F$ are modified in the recording section in the same manner as described in connection with the embodiment of FIG. 9. In the reproducing section, the matrix 60 delivers signals $R_{F\alpha}$ and $L_{F\alpha}$ to binaural localization networks 12-5, 12-6 and crosstalk cancellation networks 14-5, 14-6, and through adders 81, 82 to derive signals corresponding to $R_F$ and $L_F$ at the output of adders 81 and 82, respectively, for application to the speakers 101 and 102. The matrix 60 also delivers signals corresponding to $R_B$ and $L_B$ for application to speakers 103 and 104.

Figure 13:
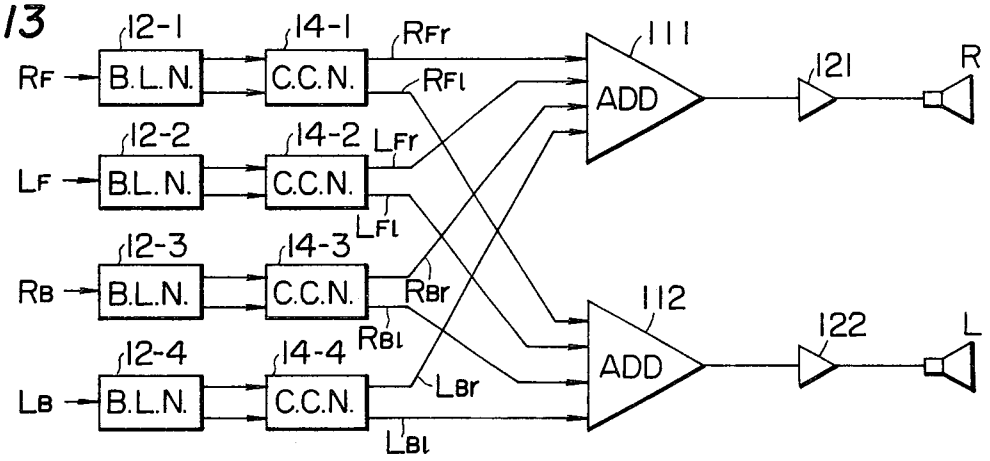
FIG. 13 is a schematic diagram of a third embodiment of the invention which permits reproduction of a pseudo-quadraphonic effect in a two-speaker arrangement based upon the non-localized quadraphonic signals.

FIG. 13 is an illustration of a third embodiment of the invention incorporating the basic functional blocks as previously described to permit two loudspeakers to reproduce four-channelled stereophonic signals. Original right- and left-forward signals $R_F$ and $L_F$ are applied to binaural localization networks 12-1 and 12-2, respectively, and thence to crosstalk cancellation circuits 14-1 and 14-2, respectively, as in the first embodiment, to derive a pair of signals $R_{Fr}$ and $L_{Fl}$ from the network 14-1 and a pair of signals $l_{Fr}$ and $l_{Fl}$ from the network 14-2. Similarly, the original right- and left-backward signals $R_B$ and $L_B$ are applied to binaural localization networks 12-3 and 12-4 respectively and thence to crosstalk cancellation networks 14-3 and 14-4 to deliver a pair of signals $R_{Br}$ and $R_{Bl}$ from the networks 14-3 and a pair of signals $L_{Br}$ and $L_{Bl}$ from the network 14-4. An adder 111 is provided which receives the rightward components of the outputs from the networks 14-1 to 14-4 to accomplish summation of signals $R_{Fr}$, $L_{Fr}$, $R_{Br}$ and $L_{Br}$. Likewise, an adder 112 is provide to accomplish summation to signals $R_{Fl}$, $L_{Fl}$, $R_{Bl}$ and $L_{Bl}$. The summation outputs from the adders 111 and 112 are applied through amplifiers 121 and 122 to right and left speakers R and L, respectively. As described previously, the summation outputs may be recorded into a suitable recording medium or transmitted over a suitable transmission medium such as radio broadcasting channel. Each of the binaural localization networks is so designed to create the same acoustic impression as would be obtained from the reproduction of the input four signals using four speakers.

Figure 14:
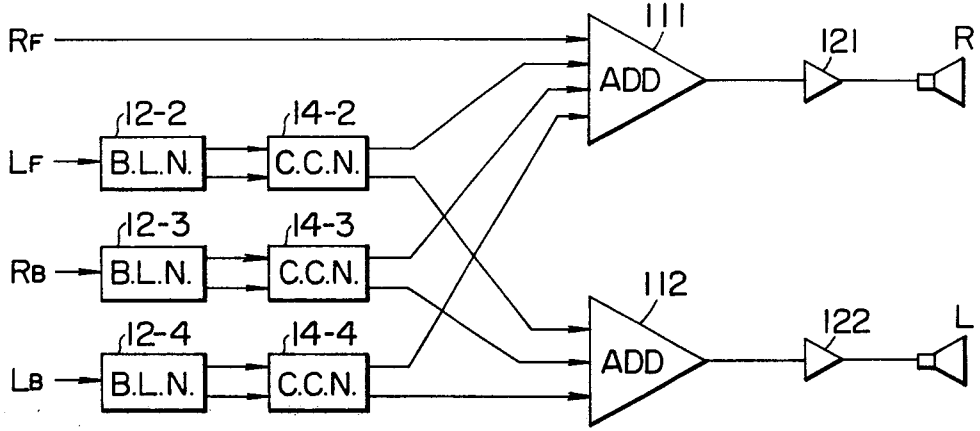
FIGS. 14–16 are schematic diagrams of modifications of the embodiment of FIG. 13.
Figure 15:
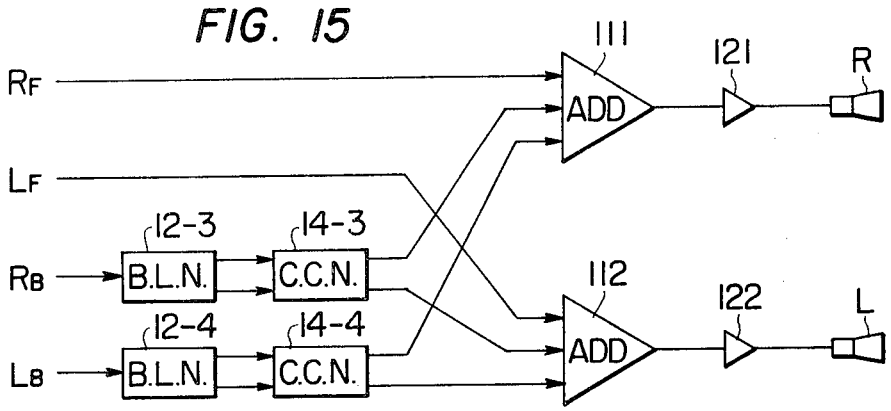
Figure 16:
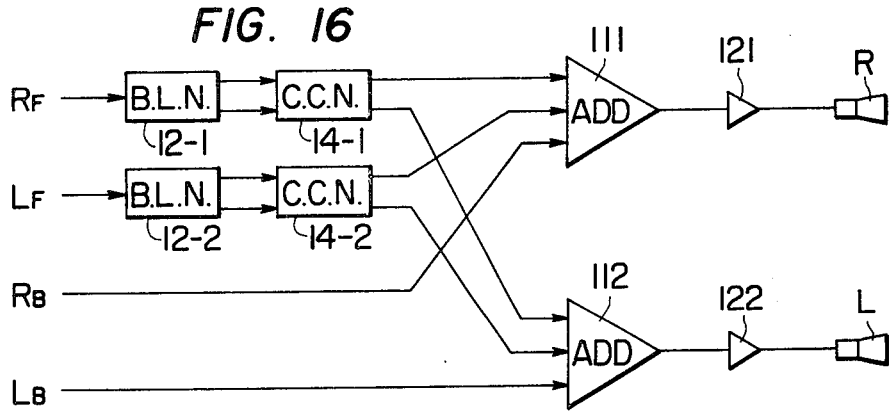

The embodiment of FIG. 13 can be modified in various ways as illustrated in FIGS. 14–16 which are generally similar to the FIG. 13 embodiment with the exception that one or more of the cascaded circuits of the binaural localization network and crosstalk cancellation network is omitted to permit direct connection of one or more of the original stereophonic signals to an adder circuit. In FIG. 14, binaural localization network 12-1 and crosstalk cancellation network 14-1 are omitted to permit direct connection of the right-forward signal $R_F$ to the adder 111. With this arrangement, the right-forward signal is made to localize its sonic image at the position of the right speaker R and the other signals are made to localize their sonic images at positions other than the positions of the speakers R and L. In FIG. 15, the right- and left-forward signals $R_F$ and $L_F$ are directly applied to adders 111 and 112, respectively, to localize sonic images at the positions of the speakers R and L, while the right- and left-backward signals $R_B$ and $L_b$ are modified to localize sonic images at any desired positions. The modification of FIG. 16 is to localize the right- and left-backward signals $R_B$ and $L_B$ in the positions of the speakers and the right- and left-forward signals $R_F$ and $L_F$ are used to localize at any desired positions.

Figure 19:
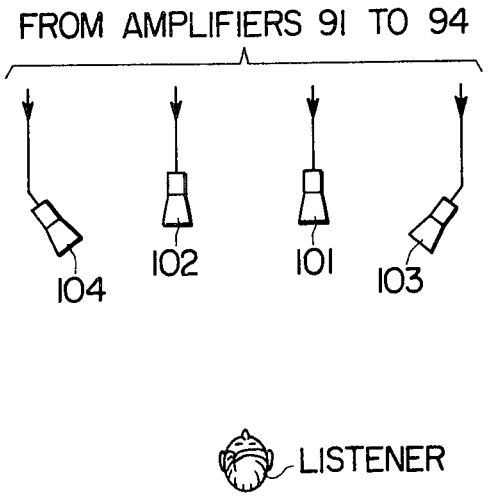
FIG. 19 is a pictorial diagram of an arrangement of four speakers utilized in the embodiment of FIG. 17.
Figure 17:
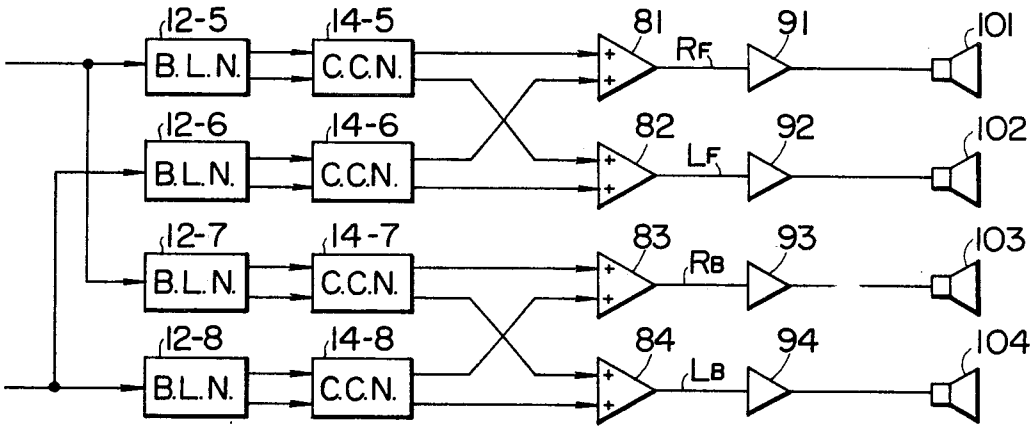
FIG. 17 is a schematic diagram of a fourth embodiment of the invention which permits reproduction of a quadraphonic effect in a four-speaker arrangement based upon the localized output signals of the embodiment of FIG. 13.

FIG. 17 is an illustration of a fourth embodiment of the invention in which the two-channelled signal output of the embodiment of FIG. 13 is used to operate four speakers to reproduce the original four-channel stereophonic signals. The output from the adder 111 of FIG. 13 is applied to binaural localization networks 12-5 and 12-7 and the output from the adder 112 of FIG. 13 is applied to binaural localization networks 12-6 and 12-8. As mentioned in the previous embodiments, these signals are processed through the associated crosstalk cancellation networks. Adders 81 to 84 provides summation of the outputs for the cancellation networks in the same manner as described previously to energize speakers 101 through 104, respectively. The localization networks 12-5, 12-6, 12-7 and 12-8 are so designed that there result in the outputs of the adders 81 through 84 signals which correspond to the original signals $R_F$, $L_F$, $R_B$ and $L_B$. The circuit arrangement shown in FIG. 17 can also be used to reproduce the conventional two-channels stereophonic signals by suitably adjusting the binaural networks 12-5 through 12-8 so as to localize sonic images at any desired to positions. For example, by arranging the speakers 101 through 104 as illustrated in FIG. 19, the sonic image associated with the right signal can be created anywhere between the speakers 101 and 103 and the sonic image associated with the left signal can be created anywhere between the speakers 102 and 104.

Figure 18:
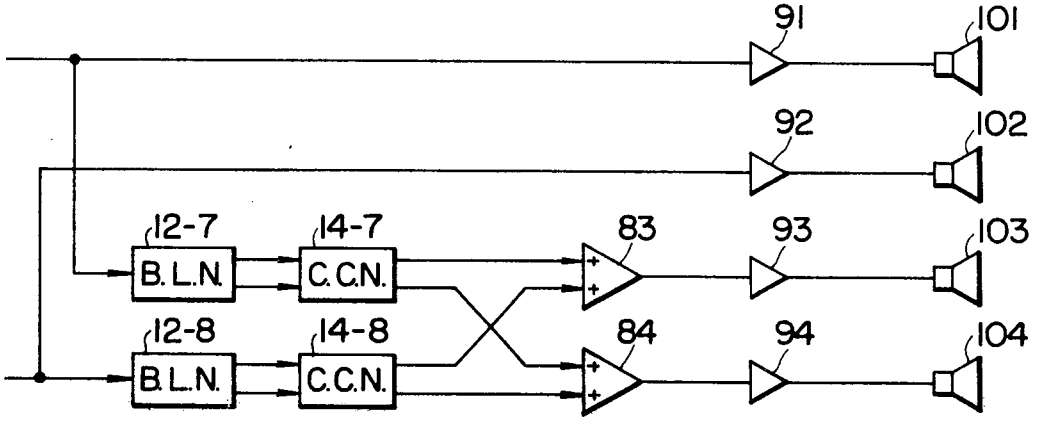
FIG. 18 is a schematic diagram of a modification of the embodiment of FIG. 17.

FIG. 18 is a modification of the embodiment of FIG. 17, in which the two-channelled signal output of the embodiment of FIG. 15 is used to operate four speakers. The output from the adder 111 of the FIG. 15 embodiment is applied on the one hand directly to speaker 101 via amplifier 91 and on the other hand to binaural localization network 12-7 and thence to crosstalk cancellation network 14-7. The output from the adder 112 of the FIG. 15 embodiment is applied on the one hand to speaker 102 via amplifier 92 and on the other hand to binaural localization network 12-8 and thence to crosstalk cancellation network 14-8. Adders 83 and 84 provide summation of the outputs of the cancellation networks 14-7 and 14-8 as in the previous manner to drive speakers 103 and 104 respectively via amplifiers 93 and 94. In this circuit arrangement, the sonic images associated with the right and left original signals $R_F$ and $L_F$ are respectively localized at the position of the right and left speakers 101 and 102, while the other localized signals are made to appear to originate from any desired positions.

What is claimed is:

1. Apparatus for modifying four-channel stereophonic signals into a form suitable for reproduction on two-speaker systems, comprising:

first binaural localization network means receptive of signals from a first signal source for developing a first binaural representation of said first signal, said first binaural representation consisting of first and second binaurally correlated signals which localize a binaural sonic image at a first location;

second binaural localization network means receptive of signals from a second signal source for developing a second binaural representation of said second signal, said second binaural representation consisting of first and second binaurally correlated signals which localize a binaural sonic image at a second location;

first crosstalk cancellation network means receptive of said first and second binaurally correlated signals developed by said first binaural localization network means for developing third and fourth binaurally correlated signals which, when applied to loudspeakers, will produce no acoustic crosstalk which might be perceptible by a listener if the last-mentioned first and second binaurally correlated signals were supplied directly to said loudspeakers;

second crosstalk cancellation network means receptive of said first and second binaurally correlated signals developed by said second binaural localization network means for developing third and fourth binaurally correlated signals, which, when applied to loudspeakers, will produce no acoustic crosstalk which might be perceptible by a listener if the last-mentioned first and second binaurally correlated signals were supplied directly to said loudspeakers;

first additive network means receptive of said third signals from said first and second crosstalk cancellation network means to provide a first additive output signal;

second additive network means receptive of said fourth signals from said first and second crosstalk cancellation network means to provide a second additive output signal;

first algebraically combining means to provide summation of said first additive output signal and signals from a third signal source; and second algebraically combining means to provide summation of said second additive output signal and signals from a fourth signal source.

2. Apparatus as claimed in claim 1, wherein said third and fourth signal sources comprises:

third binaural localization network means receptive of signals from a signal source for developing a third binaural representation of the received signal, said third binaural representation consisting of first and second binaurally correlated signals which localize a binaural sonic image at a third location;

fourth binaural localization network means receptive of signals from a signal source for developing a fourth binaural representation of the received signal, said fourth binaural representation consisting of first and second binaurally correlated signals which localize a binaural sonic image at a fourth location;

third crosstalk cancellation network means receptive of said first and second binaurally correlated signals developed by said third binaural localization network means for developing third and fourth binaurally correlated signals which, when applied to loudspeakers, will produce no acoustic crosstalk which might be perceptible by a listener if the last-mentioned first and second binaurally correlated signals were supplied directly to said loudspeakers;

fourth crosstalk cancellation network means receptive of said first and second binaurally correlated signals developed by said fourth binaural localization network means for developing third and fourth binaurally correlated signals which, when applied to loudspeakers, will produce no acoustic crosstalk which might be perceptible by a listener if the last-mentioned first and second binaurally correlated signals were supplied directly to said loudspeakers;

third additive network means receptive of said third signals from said third and fourth binaural localization network means to provide a third additive output signal which is said signals from said third signal source; and fourth additive network means receptive of said fourth signals from said third and fourth binaural localization network means to provide a fourth additive output signal which is said signals from said fourth signal source.

3. Apparatus as claimed in claim 1, further comprising:

third algebraically combining means for providing a signal representative of the difference between said first additive output signal and signals from said third source; and fourth algebraically combining means for providing a signal representative of the difference between said second additive output signal and signals from said fourth source.

4. Apparatus as claimed in claim 2, further comprising:

third algebraically combining means for providing a signal representative of the difference between said first additive output signal and said third additive output signal; and fourth algebraically combining means for providing a signal representative of the difference between said second additive output signal and said fourth additive output signal.

5. Apparatus as claimed in claim 1 or 2, wherein each of said localization network means comprises:

means receptive of the respective sound source signal and having a frequency characteristic determined in relation to the location of said sonic image to develop said first binaurally correlated signal; and means receptive of said first binaurally correlated signal and having a frequency response characteristic representing the difference in intensity and propagation time over the frequency range of said first binaurally correlated signal between a first and a second hypothetical acoustic signal which would be received at respective ears of a listener from said localized sonic image if he were seated with respect thereto, to thereby develop said second binaurally correlated signal.

6. Apparatus as claimed in claim 5, wherein each of said crosstalk cancellation network means comprises:

first and second subtractors each having positive and negative input terminals and an output terminal, the positive input terminal of the first subtractor being receptive of said first binaurally correlated signal, the positive input terminal of said second subtractor being receptive of said second binaurally correlated signal;

first and second filter-and-delay networks each having a transfer characteristic B/A wherein A represents a transmission characteristic over an acoustic path between a said loudspeaker and a said listener's ear nearer to said loudspeaker and B represents a transmission characteristic over an acoustic path between said loudspeaker and the listener's the other ear, the first filter-and-delay network being receptive of said first binaurally correlated signal for application of its output signal to the negative input terminal of said first subtractor; and third and fourth filter-and-delay networks each having a transfer characteristic represented by $T/A/1-(B/A)^2$, the third filter-and-delay network being receptive of the output signal from the first subtractor and the fourth filter-and-delay network being receptive of the output signal from the second subtractor, the output signals from the third and fourth filter-and-delay networks being said third and fourth binaurally correlated signals.

7. Apparatus for reproducing four-channel stereophonic signals including a first summation signal (Rf+Rb), a second summation signal (Lf+Lb), a first difference signal (Rf−Rb) and a second difference signal (Lf−Lb) using a set of four loudspeakers arranged in sapced relation to each other, comprising:

means for converting said first and second summation signals and said first and second difference signals to develop a set of signals Rf, Lf, Rb and Lb;

first binaural localization network means receptive of said signal Rf for developing a first binaural representation consisting of first and second binaurally correlated signals which localize a binaural sonic image at a first location;

second binaural localization network means receptive of said signal Lf for developing a second binaural representation consisting of first and second binaurally correlated signals which localize a binaural sonic image at a second location;

first crosstalk cancellation network means receptive of said first and second binaurally correlated signals developed by said first binaural localization network means for developing third and fourth binaurally correlated signals which, when applied to loudspeakers, will produce no acoustic crosstalk which might be perceptible by a listener if the last-mentioned first and second binaurally correlated signals were supplied directly to said loudspeakers;

second crosstalk cancellation network means receptive of said first and second binaurally correlated signals developed by said second binaural localization network means for developing third and fourth binaurally correlated signals which, when applied to loudspeakers, will produce no acoustic crosstalk which might be preceptible by a listener if the last-mentioned first and second binaurally correlated signals were supplied directly to said loudspeakers;

first additive network means receptive of said third signals from said first and second crosstalk cancellation network means to provide a first additive output signal for energization of a first loudspeaker;

second additive network means receptive of said fourth signals from said first and second crosstalk cancellation network means to provide a second additive output signal for energization of a second loudspeaker;

means for applying said signals Rb and Lb to third and fourth loudspeakers, respectively.

8. Apparatus as claimed in claim 7, wherein said signal applying means comprises:

third binaural localization network means receptive of said signal Rb for developing a third binaural representation consisting of first and second binaurally correlated signals which localize a binaural sonic image at a third location;

fourth binaural localization network means receptive of said signal Lb for developing a fourth binaural representation consisting of first and second binaurally correlated signals which localize a binaural sonic image at a fourth location;

third crosstalk cancellation network means receptive of said first and second binaurally correlated signals developed by said third binaural localization network means for developing third and fourth binaurally correlated signals which, when applied to loudspeakers, will produce no acoustic crosstalk which might be perceptible by a listener if the last-mentioned first and second binaurally correlated signals were supplied directly to said loudspeakers;

fourth crosstalk cancellation network means receptive of said first and second binaurally correlated signals developed by said fourth binaural localization network means for developing third and fourth binaurally correlated signals which, when applied to loudspeakers, will produce no acoustic crosstalk which might be perceptible by a listener if the last-mentioned first and second binaurally correlated signals were supplied directly to said loudspeakers;

third additive network means receptive of said third signals from said third and fourth crosstalk cancellation network means to provide a third additive output signal to develop an output to energize said third loudspeaker; and fourth additive network means receptive of said fourth signals from said third and fourth crosstalk cancellation network means to provide a fourth additive output signal to develop an output to energize said fourth loudspeaker.

9. A recording medium in which signals from the first and second algebraically combining means as claimed in claim 1 are recorded on separate channels.

10. A method for processing four-channel stereophonic signals into a form suitable for reproduction on two-speaker systems, comprising the steps of:

modifying signals from a first signal source to develop a first pair of first and second binaurally correlated signals which render said first source signal to appear to originate from a first location;

modifying signals from a second signal source to develop a second pair of first and second binaurally correlated signals which render said second source signal to appear to originate from a second location;

modifying said first pair of first and second binaurally correlated signals to develop a first pair of third and fourth binaurally correlated signals which, when used to produce sounds, will produce no acoustic crosstalk which might be perceptible by a listener if said first pair of first and second binaurally correlated signals were directly used to produce sounds;

modifying said second pair of first and second binaurally correlated signals to develop a second pair of third and fourth binaurally correlated signals which, when used to produce sounds, will produce no acoustic crosstalk which might be perceptible by a listener if said second pair of first and second binaurally correlated signals were directly used to produce sounds;

providing summation of said third signals of said first and second pairs to produce a first additive output signal;

providing summation of said fourth signals of said first and second pairs to produce a second additive output signal;

providing summation of said first additive output signal and signals from a third signal source to produce a first localized output signal; and providing summation of said second additive output signal and signals from a fourth signal source to produce a second localized output signal.

11. A method as claimed in claim 10, wherein said signals from said third and fourth signal sources are produced by the steps of:

modifying signals from a signal source to develop a third pair of first and second binaurally correlated signals which render said signals from the last-mentioned signal source to appear to originate from a third location;

modifying signals from a signal source to develop a fourth pair of first and second binaurally correlated signals which render said signals from the last-mentioned signal source to appear to originate from a fourth location;

modifying said third pair of first and second binaurally correlated signals to develop a first pair of third and fourth binaurally correlated signals which, when used to produce sounds, will produce no acoustic crosstalk which might be perceptible by listener if said third pair of first and second binaurally correlated signals were used to produce sounds;

modifying said fourth pair of first and second binaurally correlated signals which, when used to produce sounds, will produce no acoustic crosstalk which might be perceptible by a listener if said fourth pair of first and second binaurally correlated signals were used to produce sounds;

providing summation of said third signals of said third and fourth pairs to produce a third additive output signal which corresponds to said signals from said third signal source; and providing summation of said fourth signals of said third and fourth pairs to produce a fourth additive output signal which corresponds to said signals from said fourth signal source.

12. A method as claimed in claim 10 or 11, further comprising the step of recording said first and second localized signals on separate channels of a recording medium.

13. A method as claimed in claim 10 or 11, further comprising the step of transmitting said first and second localized signals on separate carrier signals.

14. A method as claimed in claim 10, further comprising the steps of:

generating a third localized output signal representative of the difference between said first additive output signal and signals from said third source; and generating a fourth localized output signal representative of the difference between said second additive output signal and signals from said fourth source.

15. A method as climed in claim 11, further comprising the steps of:

generating a third localized output signal representative of the difference between said first additive output signal and said third additive output signal; and generating a fourth localized output signal representative of the difference between said second additive output signal and said fourth additive output signal.

16. A method as claimed in claim 14 or 15 further comprising the step of recording said first, second, third and fourth localized output signals on separate channels.

17. A method as claimed in claim 14 or 15, further comprising the step of transmitting said first, second, third and fourth localized output signals on separate carrier signals.

* * * * *